US006312225B1

(12) United States Patent
Bussard

(10) Patent No.: US 6,312,225 B1
(45) Date of Patent: Nov. 6, 2001

(54) GEAR PUMP HAVING A MULTISHAFT DRIVE AND METHOD OF OPERATING SAME

(75) Inventor: Maurice Bussard, Neuenhof (CH)

(73) Assignee: Maag Pump Systems Textron AG, Zurich (CH)

( * ) Notice: Subject to any disclaimer, the term of this patent is extended or adjusted under 35 U.S.C. 154(b) by 0 days.

(21) Appl. No.: 09/382,830

(22) Filed: Aug. 25, 1999

(30) Foreign Application Priority Data

Aug. 25, 1998 (EP) ..... 98115962

(51) Int. Cl.[7] ..... F04B 49/00; H02P 1/54

(52) U.S. Cl. ..... 417/16; 417/17; 318/41; 318/85

(58) Field of Search ..... 417/16, 17, 22; 318/77, 85, 41, 52, 66, 69

(56) References Cited

U.S. PATENT DOCUMENTS 5,197,861 * 3/1993 Maruyama et al. ..... 417/42
5,329,216 * 7/1994 Hasegawa et al. ..... 318/654
5,767,635 * 6/1998 Steffens et al. ..... 318/85

FOREIGN PATENT DOCUMENTS

3928451A1 3/1991 (DE) .
3230550A1 1/1994 (DE) .
0472933A2 3/1992 (EP) .
0502459A2 9/1992 (EP) .
WO94/29596 12/1994 (WO) .

OTHER PUBLICATIONS

European Patent Office Search Report, Feb. 3, 1999.

* cited by examiner

*Primary Examiner*—Teresa Walberg
*Assistant Examiner*—Thor Campbell
(74) *Attorney, Agent, or Firm*—Crowell & Moring LLP

(57) ABSTRACT

A gear pump having two meshing gears which are each assigned to a shaft and which are each driven by a driving unit. The driving units are controllable by a control unit such that the shafts rotate at a definable angular velocity. The control units having a symmetrical construction, and a control device provided in each control unit, each control device being connected to the other by way of a data line.

9 Claims, 1 Drawing Sheet

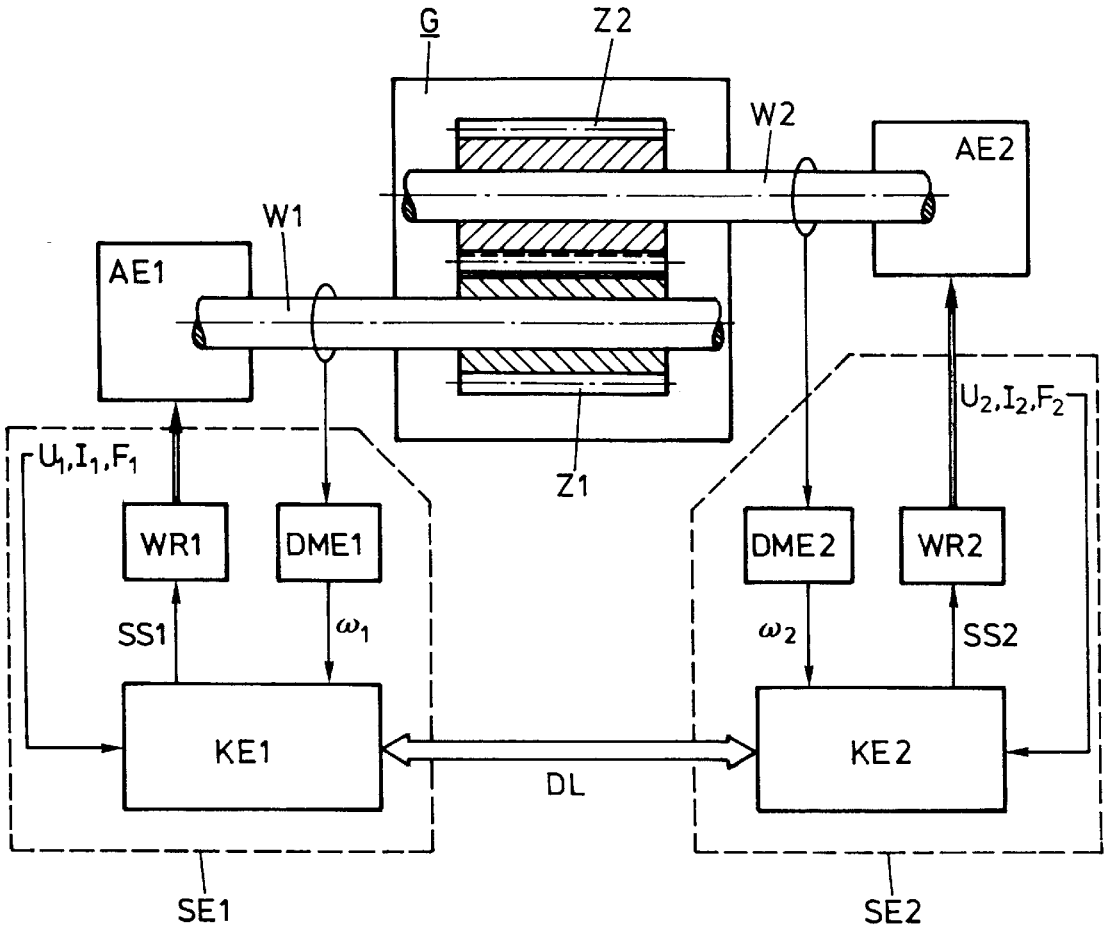
G
Z2
W2
AE2
W1
AE1
Z1
U1,I1,F1
U2,I2,F2
WR1
DME1
DME2
WR2
SS1
ω1
ω2
SS2
KE1
DL
KE2
SE1
SE2

GEAR PUMP HAVING A MULTISHAFT DRIVE AND METHOD OF OPERATING SAME

BACKGROUND AND SUMMARY OF THE INVENTION

This application claims the priority of European application 98 115 962.7, filed in the European patent Office on Aug. 25, 1998, the disclosure of which is expressly incorporated by reference herein.

The present invention relates to a gear pump having two mutually meshing gears which are each assigned to a shaft and which are each driven by means of a driving unit, the driving units each being drivable by a control unit such that the shafts rotate at a definable rotational velocity.

Normally, gear pumps are driven by a single shaft which extends out of the pump casing. In cases with very high torques or when the flow medium is charged with fillers, two-shaft arrangements are occasionally also used in order to protect the tooth surfaces from wear or excess strain.

Known multishaft drives include timing gears which ensure that the tooth surfaces do not come in contact with one another. In the case of the known multishaft drives, a single driving unit is used, the force distribution onto the individual shafts taking place by means of the engaging gears by way of the above-mentioned timing gear.

Furthermore, a teaching is known from German Patent Document DE-32 30 550C2 in which a two-shaft drive is described which has two driving units. In this case, direct-current motors are used with a control unit which is based on current measurements in the exciting circuit of both driving units and on a rotational velocity measurement in the case of one driving unit. In this known teaching, a desired rotational velocity and a desired power ratio can be defined.

The last-mentioned driving concept has the disadvantage that, as the result of the rotational velocity monitoring taking place only on one side, in the event of a clutch, transmission or pump gearing damage, the line in which the rotational velocity is not monitored may cause consequent damage by endeavoring to reach the desired power. Furthermore, the power ratio can be adjusted only in a narrow range of from 0.5 to 1. Finally, this system is not suitable for appropriately detecting and taking into account torque pulsations because of the intervention point shifting on the intervention line, because of minimal gearing inaccuracies or differences in the rigidities of the engine mounting and transmission mounting.

It is therefore an object of the present invention to provide a gear pump which does not have the above-mentioned disadvantages.

This object is achieved by providing a gear pump of the above noted type, wherein the control units are operably connected by way of a data line. Further advantageous features of preferred embodiments of the present invention are described below and in the claims.

Preferred embodiments of the invention have the following advantages. In that a completely symmetrical structure for the control units for controlling the driving units is provided and, in addition, a fast data transmission is provided between the two control devices contained in the control units, it is achieved that, despite possible torque pulses on the shafts, the tooth surfaces will neither lift off, nor can an excess torque which is too high be transmitted by way of the tooth surfaces.

Other objects, advantages and novel features of the present invention will become apparent from the following detailed description of the invention when considered in conjunction with the accompanying drawings.

BRIEF DESCRIPTION OF THE DRAWINGS

The single drawing FIGURE is a schematic representation of a gear pump having two identical control units according to preferred embodiments of the invention.

DETAILED DESCRIPTION OF THE DRAWINGS

The drawing figure schematically depicts a gear pump having a two-shaft drive and two control units SE1 and SE2 according to the invention. The gear pump has two mutually meshing gears Z1 and Z2 which are assigned to two different gear shafts W1 and W2. The gears Z1 and Z2 and the shafts W1 and W2 are contained in a pump casing G. The shafts W1 and W2 extend to the outside and the projecting ends of the shafts W1 and W2 are each coupled with a driving unit AE1 and AE2.

According to the invention, the control units SE1 and SE2 have a symmetrical construction and include one control device KE1 and KE2 respectively, one inverse rectifier WR1 and WR2 respectively as a power converter, and one rotational velocity measuring unit DME1 and DME2 respectively as measuring units which are each connected with a signal generator of the known type mounted on the shafts W1 and W2. In the rotational velocity measuring units DME1 and DME2, the signal measured in the signal generator is processed for the determination of the angular velocities $\omega 1$ and $\omega 2$, these then being transmitted to the control devices KE1 and KE2.

In the control devices KE1 and KE2, the respective control signals SS1 and SS2 are generated for controlling the respective inverse rectifiers WR1 and WR2. For this purpose, in addition to the angular velocity $\omega 1$ and $\omega 2$, output signals for the driving units AE1 and AE2 are also used which are generated by the inverse rectifier WR1 and WR2, whereby possible non-linearities or asymmetries of the inverse rectifiers WR1 and WR2 are automatically compensated.

In a preferred embodiment of the invention, the driving units AE1 and AE2 are of the electric asynchronous machine type (Rolf Fischer, "Electric Machines", 5th Edition, Carl Hanser Verlag, 1983, pages 170 to 260). The output signals generated by the inverse rectifier WR1 and WR2 are indicated in the drawing figure by U1 and U2 for the electric voltage, and by I1 and I2 for the electric current and by F1 and F2 for the frequency.

As mentioned above, the output signals U1, I1, F1 and U2, I2, F2 are returned into the control device KE1 and KE2 for a precise adjustment. This provides a first internal control circuit for adjusting the rotational velocity of the shafts W1 and W2. Specifically, if the driving units AE1 and AE2 are conceived as electromechanical converters, the voltage frequencies F1 and F2 are imaged on the angular velocities $\omega 1$ and $\omega 2$, and the voltages U1 and U2 and currents I1 and I2 are imaged on corresponding driving torques (vector drives). Another control circuit is created by measuring the rotational shaft velocity by means of rotational velocity measuring units DME1 and DME2 and returning the measured signals into the respective control devices KE1 and KE2. In the context of the present invention, this second control circuit will be called an external control circuit.

According to the invention, a fast data line DL, preferably in the form of a data bus, is provided between the two control units SE1 and SE2, by way of which the angular velocities ω1 and ω2 of the two shafts W1 and W2 and the position of the gears Z1 and Z2 can be precisely coordinated or adjusted with respect to one another. The data line DL is provided so that angular velocity differences can be reliably processed within the control units SE1 and SE and that, despite possible torque pulses, neither a lifting-off of the tooth surfaces, which are to remain in contact, is caused, nor is an excess torque, which is too high, transmitted by way of the tooth surfaces.

In another embodiment of the invention, it is provided that a computer unit is connected to the data line DL constructed as a data bus, by means of which computer unit a rotational velocity adjustment can, for example, take place, particularly in connection with other process components, with which the gear pump is connected.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of operating a gear pump which has two mutually meshing gears supported on respective shafts driven by respective driving units, said method comprising:

controlling the driving units by respective control units operably connected by a data line to thereby precisely coordinate the angular velocities to avoid excess torque forces on teeth of the meshing gears while preventing a lifting off of surfaces of the teeth, during pumping operations.

2. A method according to claim 1, wherein the control units are constructed symmetrically with respect to one another.

3. A method according to claim 1, wherein a power converter is provided for each driving unit, each power converter being operatively connected with a respective driving unit, and wherein a control device is provided in each control unit for generating control signals which act upon the corresponding power converters, the data line existing between the two control units being guided to the respective control devices.

4. A method according to claim 3, wherein the power converter output signals, or signals proportional thereto, are returned into the corresponding control device.

5. A method according to claim 1, wherein the driving units are of the asynchronous machine type.

6. A method according to claim 5, wherein the power converters are of the inverse rectifier type for generating current, voltage and frequency.

7. A method according to claim 1, wherein a rotational velocity measuring unit is provided for each shaft for determining the respective rotational shaft velocity and/or the respective position of the shafts with respect to one another, the rotational velocity measuring units each being operatively connected with the corresponding control device.

8. A method according to claim 1, wherein the power ratio between the two driving units can be adjusted between 0.05 and 1.

9. A method according to claim 1, wherein a computer unit is connected to the data line.

* * * * *